US005954231A

United States Patent [19]

Durliat et al.

[11] Patent Number: 5,954,231

[45] Date of Patent: Sep. 21, 1999

[54] HINGED CLOSURE FOR A DUAL CHAMBER DISPENSING PACKAGE

[75] Inventors: Leonora M. Durliat, Toledo; Maximillian Kusz, Waterville, both of Ohio

[73] Assignee: Owens-Illinois Closure Inc., Toledo, Ohio

[21] Appl. No.: 09/233,613

[22] Filed: Jan. 19, 1999

Related U.S. Application Data

[62] Division of application No. 08/872,656, Jun. 10, 1997.

[51] Int. Cl.[6] ..... B67B 7/00

[52] U.S. Cl. ..... 222/1; 222/92; 222/94; 264/512

[58] Field of Search ..... 222/1, 92, 94, 222/556, 482, 546, 517; 264/512, 513, 515, 537, 539, 540

[56] References Cited

U.S. PATENT DOCUMENTS

| | | | |
|---|---|---|---|
| D. 315,496 | 3/1991 | Pettengill . | |
| D. 356,026 | 3/1995 | Iaia et al. . | |
| 2,826,339 | 3/1958 | Maillard . | |
| 3,081,926 | 3/1963 | Newton . | |
| 3,166,221 | 1/1965 | Nielsen . | |
| 3,390,814 | 7/1968 | Creighton et al. . | |
| 3,782,600 | 1/1974 | Columbus . | |
| 4,541,540 | 9/1985 | Gretz et al. . | |
| 4,638,916 | 1/1987 | Beck et al. | 222/517 X |
| 4,651,900 | 3/1987 | Horvath et al. . | |
| 4,687,663 | 8/1987 | Schaeffer . | |
| 4,964,539 | 10/1990 | Mueller . | |
| 5,020,694 | 6/1991 | Pettengill . | |
| 5,038,963 | 8/1991 | Pettengill et al. . | |
| 5,052,590 | 10/1991 | Ratcliff . | |
| 5,135,823 | 8/1992 | Eales . | |
| 5,242,653 | 9/1993 | Olle | 264/539 X |
| 5,244,120 | 9/1993 | O'Meara . | |
| 5,262,119 | 11/1993 | Smith | 264/539 X |
| 5,269,441 | 12/1993 | O'Meara . | |
| 5,277,329 | 1/1994 | Pomroy et al. . | |
| 5,289,949 | 3/1994 | Gentile . | |
| 5,318,203 | 6/1994 | Isia et al. . | |
| 5,323,926 | 6/1994 | Pomroy et al. . | |
| 5,332,124 | 7/1994 | Cancro . | |
| 5,335,827 | 8/1994 | Gentile . | |
| 5,344,024 | 9/1994 | Cohu . | |
| 5,356,040 | 10/1994 | Reggiani . | |
| 5,417,338 | 5/1995 | Roy et al. . | |
| 5,462,192 | 10/1995 | Pomroy et al. . | |
| 5,489,035 | 2/1996 | Fuchs . | |
| 5,499,736 | 3/1996 | Kohl . | |
| 5,800,770 | 9/1998 | Smith et al. | 264/539 X |
| 5,823,391 | 10/1998 | Klauke et al. | 222/94 |

FOREIGN PATENT DOCUMENTS

| | | |
|---|---|---|
| 2540075 | 8/1984 | France . |
| 190636 | 12/1985 | Japan . |
| 387660 | 9/1991 | Japan . |

*Primary Examiner*—Gregory L. Huson

[57] ABSTRACT

A dual chamber closure and dual closure chamber package including dual chambers which have outlets and a common wall between the outlets. The closure comprises a first portion that is snapped into position on the outlets and a second portion hinged to the first portion and providing a cover closing the outlets. Each outlet has a top surface with an annular groove. The second portion of the closure includes complementary annular beads which engage the grooves and provide a seal. The second portion of the closure preferably includes an inner skirt that surrounds and engages an axial wall on the first portion. The second portion further includes an outer skirt that engages a shoulder on the first portion of the closure. Each outlet further includes an annular wall having an annular bead on the external surface thereof which is engaged by snap action with an internal annular bead on the annular wall of the first portion of the closure. In one form, the dual chamber package comprises a container formed by two substantially identical plastic tubes with D-shaped outlets. In another form, the container has rectangular outlets and may include two separate containers. In another form, the container is a single plastic container with two chambers and two outlets from the chambers.

8 Claims, 4 Drawing Sheets

HINGED CLOSURE FOR A DUAL CHAMBER DISPENSING PACKAGE

This application is a division of application Ser. No. 08/872,656 filed Jun. 10, 1997.

BACKGROUND AND SUMMARY OF THE INVENTION

In dispensing of various products, it has been common to have dual chamber packages which may consist of side-by-side plastic containers, plastic tubes, or a plastic container having dual chambers. In order to provide closures for such packages, it has been proposed to utilize separate threaded closures for each chamber or closures with adapters.

It has heretofore been suggested that two flexible tubes can be brought together to form a dual flexible tube package, as shown for example, in U.S. Pat. Nos. 3,782,600, 4,687,663, 5,052,590, 5,244,120, 5,269,441 and 5,318,203.

In U.S. Pat. No. 5,318,203, there is disclosed the concept of utilizing elongated hollow flexible tubes, each of which has an upper end and lower end wherein the upper end is D-shaped in cross section. The upper ends of the tubes are attached to a coupling which is joined to a dispensing base. The coupling has two exit orifices, one for each tube. The dispensing base includes two nozzles which are inserted into the two orifices.

In copending application Ser. No. 08/707,564, now U.S. Pat. No. 5,823,392, filed Sep. 4, 1996, having a common assignee with the present application, the dual chamber flexible tube dispensing package comprises two substantially identical tubes that are mirror images of one another. Each tube includes a rigid half finish, a rigid half shoulder and a flexible tubular body extending from the shoulder. The cross sections of the half finish, half shoulder and body of each tube are D-shaped such that each has a flat portion and all the flat portions are in a single plane. The two tubes have the flat portions in abutting relation to one another such that the dual tube package has a finished defined by the two half finishes, a shoulder defined by the two half shoulders and a dual chamber body defined by the two flexible tube bodies. The threads on the half finishes are located thereon such that when the two tubes are brought into abutting relation a continuous thread is formed on the finish. The resultant dual chamber flexible tube packages are then filled with the respective viscous materials and the open ends are sealed to complete the package. In another form of dual chamber dispensing package, each tube has a plurality of vertically spaced integral ribs which extend transversely. The ribs on one tubes are staggered relative to the ribs on the other tube so that when the tubes are brought into engagement, the ribs on one tube engage the ribs on the tube and the first portions of the shoulders are in abutment. Each rib is convex outwardly when viewed in transverse cross section.

Each tube of the dual chamber flexible tube dispensing packages is formed by providing a plastic parison, blow molding each parison to form a container having rigid half finish, a rigid half shoulder adjacent the finish and a flexible body extending from the shoulder to a rigid closed lower end. The rigid closed end of each container is cut-off to produce the two tubes. The flat portions of the two tubes are then brought into abutting relationship such that when the flat walls of the two tubes are in abutting relation, the thread on the half finish on one tube forms a continuous thread with the thread of the half finish on the other tube. This results in the dual chamber flexible tube dispensing package. The overall cross sectional configurations of the shoulder and flexible body are generally oval with the major axis at ninety degrees to the abutting flat portions.

In U.S. Pat. Nos. 5,020,694, 5,289,949, 5,318,203, 5,332,124 and 5,335,827 there are disclosed dual dispensing packages wherein a pump type package has a dual dispensing nozzle with a hinged closure that seals by plug like seals.

Among the objectives of the invention are to provide a closure that is readily applied to form a dual dispensing package and provides access to the two chambers by single motion of opening the closure; wherein the closure provides a seal without the need for resilient or plug seals; wherein the closure can be readily applied by a snap action; a dual chamber flexible tube dispensing packages which includes a closure that can be snapped in position; which package includes integral seals; and which package includes a hinged cap and integral seals.

In accordance with the invention, the dual chamber package comprises dual chambers which have outlets and a common wall between the outlets. The closure comprises a first portion that is snapped into position on the outlets and a second portion hinged to the first portion and providing a cover closing the outlets. Each outlet has a top surface with an annular groove. The second portion of the closure includes complementary annular beads which engage the grooves and provide a seal. The second portion of the closure preferably includes an inner skirt that surrounds and engages an axial wall on the first portion. The second portion further includes an outer skirt that engages a shoulder on the first portion of the closure. Each outlet further includes an annular wall having an annular bead on the external surface thereof which is engaged by snap action with an internal annular bead on the annular wall of the first portion of the closure.

In accordance with the invention, the dual chamber flexible tube dispensing package comprises two substantially identical tubes that are mirror images of one another, except for the finishes. Each tube includes a rigid rectangular finish, a rigid half shoulder and a flexible tubular body extending from the shoulder. The cross sections of the half shoulder and body of each tube are D-shaped such that each has a flat portion and all the flat portions are in a single plane. The two tubes have the flat portions in abutting relation to one another such that the dual tube package has a finish defined by the two rectangular finishes, a shoulder defined by the two half shoulders and a dual chamber body defined by the two flexible tube bodies. A closure is provided that has a first portion which is telescoped over the two abutting rectangular finishes and a second portion hinged to the first portion. Integral seals are provided between the first portion and the rectangular finishes and integral seals are provided between the second portion and the first portion. The resultant dual chamber flexible tube packages are then filled with respective viscous materials and the open ends are sealed to complete the package.

DESCRIPTION OF THE PREFERRED EMBODIMENT

For purposes of illustration, the dual dispensing closure is described with a dual chamber flexible tube dispensing package.

Figure 1:
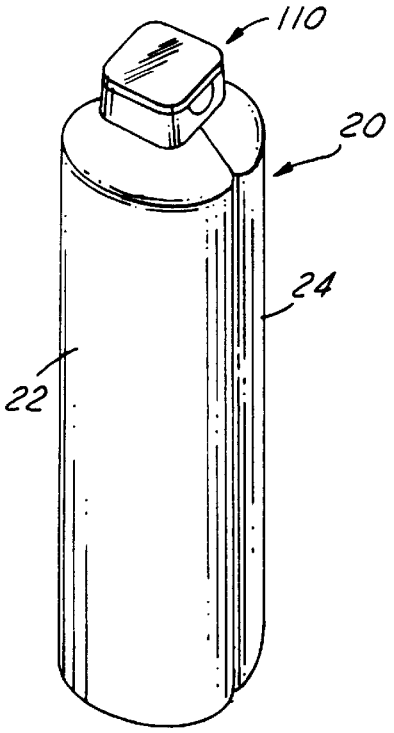
FIG. 1 is a perspective view of a dual chamber flexible tube dispensing package embodying the invention, prior to filling.
Figure 2:
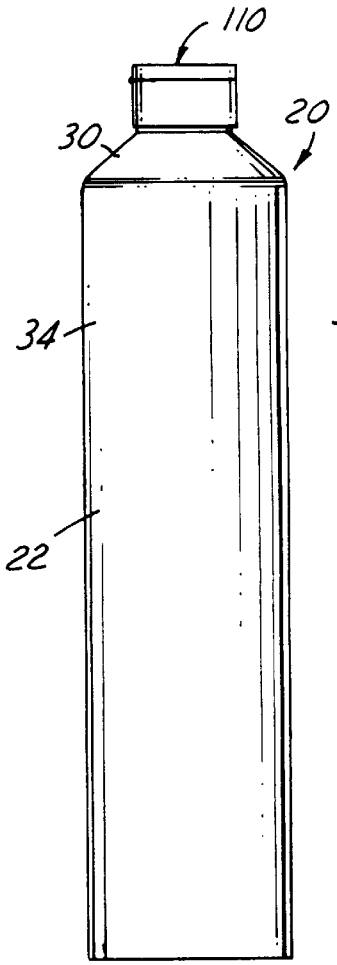
FIG. 2 is a front elevational view.
Figure 3:
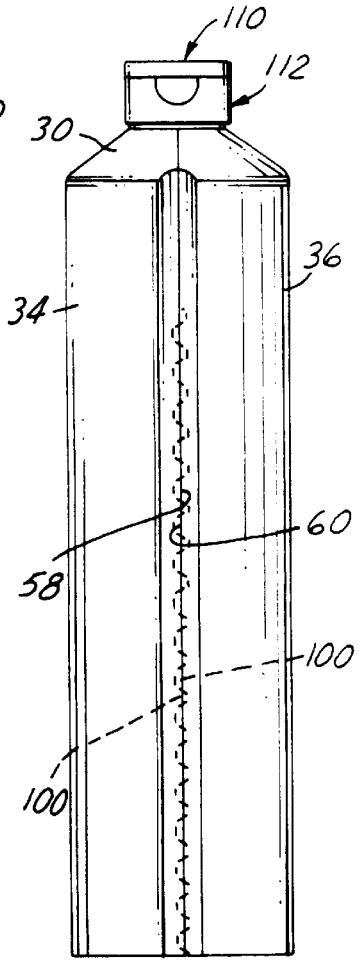
FIG. 3 is a side elevational view.
Figure 4:
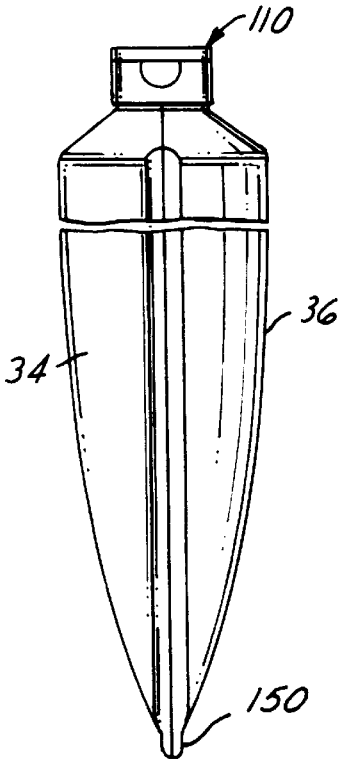
FIG. 4 is a side elevational view of the filled package.
Figure 5:
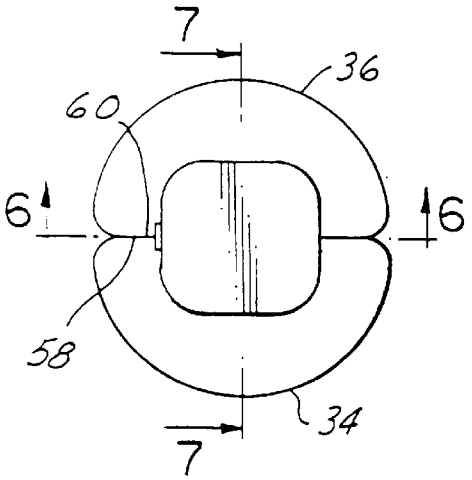
FIG. 5 is a top plan view.
Figure 6:
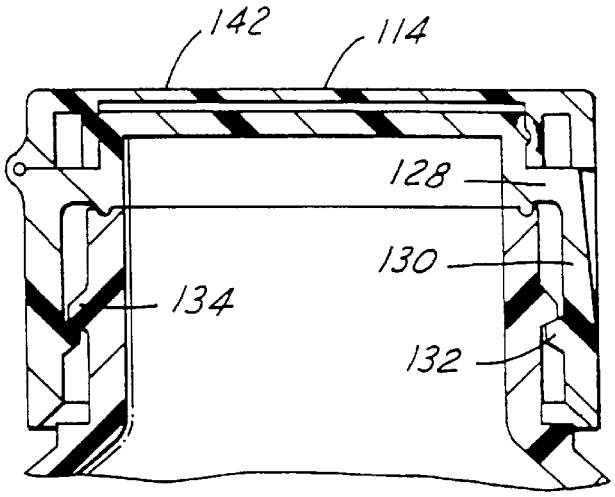
FIG. 6 is a fragmentary sectional view taken along the line 6—6 in FIG. 5.
Figure 7:
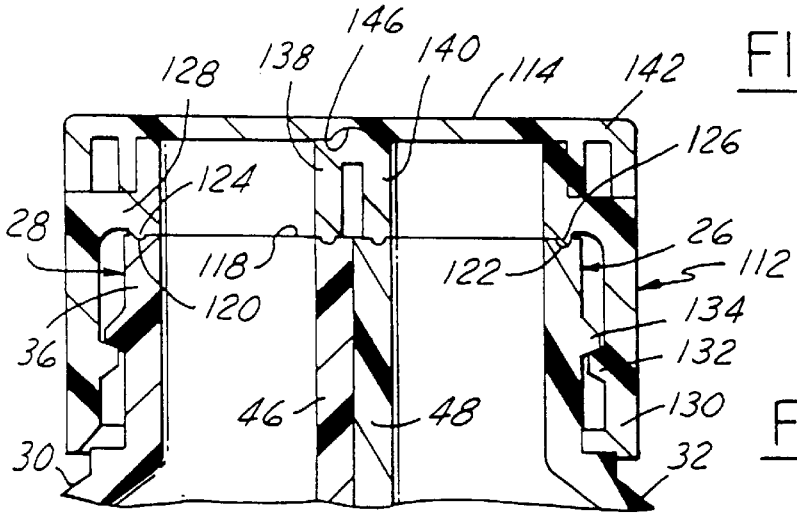
FIG. 7 is a fragmentary sectional view taken along the line 7—7 in FIG. 5.
Figure 8:
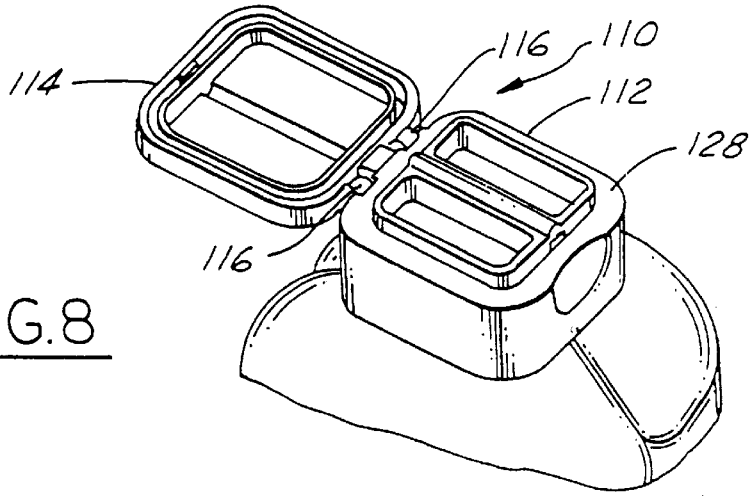
FIG. 8 is a fragmentary perspective view of the package with the closure in open position.
Figure 9:
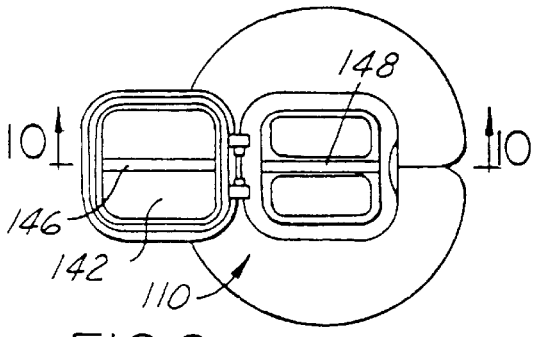
FIG. 9 is a top plan view of the package shown in FIG. 8.
Figure 11:
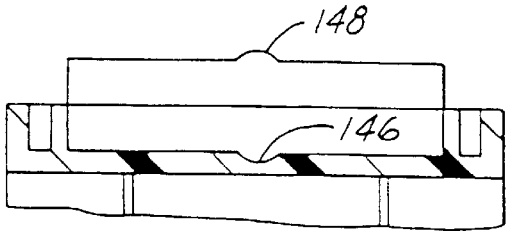
FIG. 11 is a sectional view taken along the line 11—11 in FIG. 10.
Figure 10:
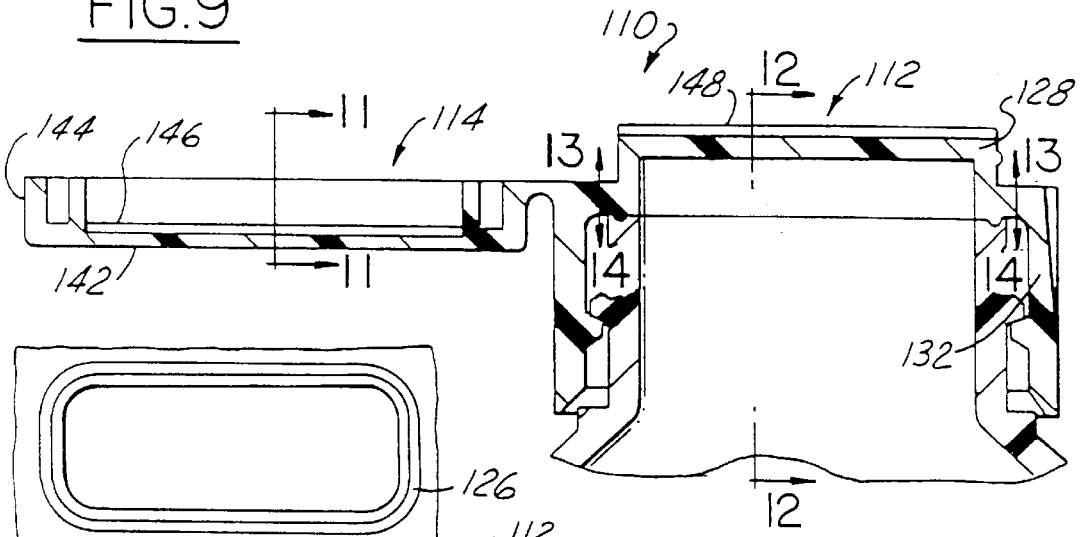
FIG. 10 is a sectional view taken along the line 10—10 in FIG. 9.
Figure 13:
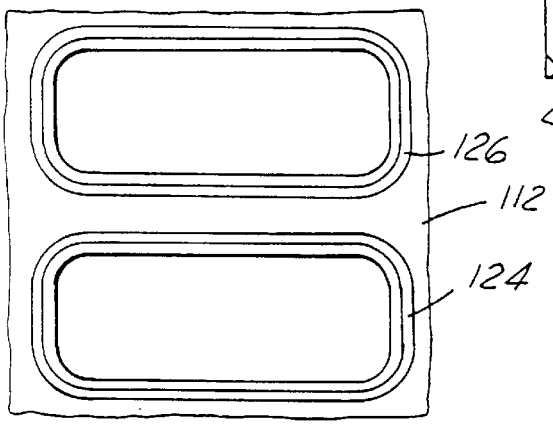
FIG. 13 is a sectional view taken along the line 13—13 in FIG. 10.
Figure 12:
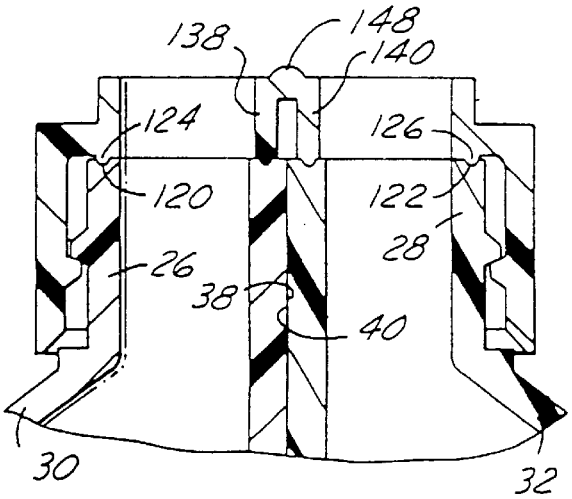
FIG. 12 is a sectional view taken along the line 12—12 in FIG. 10.
Figure 14:
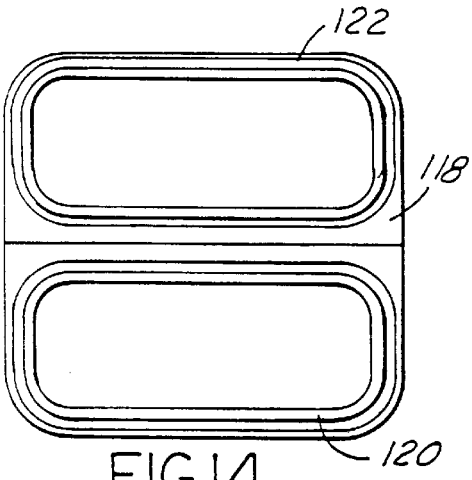
FIG. 14 is a sectional view taken along the line 14—14 in FIG. 10.
Figure 15:
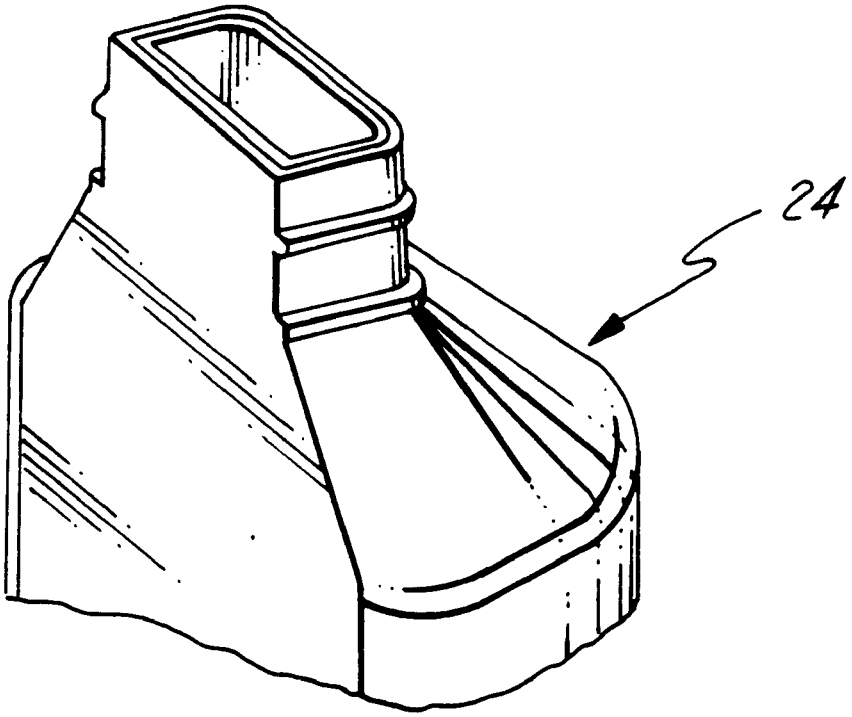
FIG. 15 is a fragmentary perspective view of one of the chambers of the packages.

Referring to FIGS. 1–15, the dual chamber flexible tube dispensing package 20 embodying the invention comprises two plastic tubes 22, 24 which are in abutting relation to one another. Each tube 22, 24 is a mirror image of the other, as presently described. Each tube 22, 24 includes a rigid rectangular finish 26, 28, an integral rigid half shoulder 30, 32, and an integral thin flexible body 34, 36, respectively. The finish 26, 28, shoulder 30, 32 and body 34, 36 of each tube 22, 24 have flat surfaces abutting one another. Each finish 26, 28 is rectangular in cross section and includes a flat portion 38, 40 and an integral interconnecting walls extending from the ends of the flat wall portions 38, 40 to define rectangular opening in each finish 26, 28, respectively. Each shoulder portion 30, 32 includes a flat portion 46, 48 and an arcuate portion 50, 52, respectively. As shown in FIGS. 1–3 and 5, the lower end of each body 22, 24 is open to provide for access for filling of the tubes 22, 24. Means are provided on the exterior of the half finish 36, 38 for interengaging a closure, as presently described. Similarly, when the half finishes 26, 28 are in abutting relation, the flat portions 38, 40 form a double wall. When the shoulder portions 30, 32 are in abutting relation, the flat portions 46, 48 define a double wall. The flat wall portions 58, 60 are also in abutting relationship to define a double wall.

Each of the tubes 22, 24 is made from a plastic parison and blow molded in accordance with well known procedures to form a hollow container which is then cut to provide the respective tube. The blow molding is done by any one well known blow molding methods such as extrusion blow molding, injection extrusion blow molding and injection molding a parison and blow molding the parison. In each, a parison is formed and blow molded. Preferred methods are extrusion blow molding and injection extrusion blow molding.

The containers and resultant tubes 22, 24 may be made of monolayer parisons or multilayer parisons depending on the viscous materials that are to be packaged. A satisfactory monolayer plastic parison is linear low density polyethylene. A satisfactory multilayer plastic extruded parison is one having an inner layer of low density polyethylene; an adhesive layer; a layer of ethylene vinyl alcohol; an adhesive layer; a layer of container regrind alone or low density polyethylene; and an outer layer of low density polyethylene alone or mixed with high density polyethylene and colorant.

The above described construction is disclosed in the aforementioned application Ser. No. 08/707,564 incorporated herein by reference.

Preferably the two tubes 22, 24 of the dual tube dispensing package are provided with interengaging means for preventing relative movement with respect to each other when they are brought together. This means includes the flat portions 58, 60 of each tube body 34, 36 which are provided with a plurality of vertically spaced integral ribs 100 which extend transversely. The ribs 100 on one tube are staggered relative to the ribs 100 on the other tube so that when the tubes are brought into engagement, the ribs 100 on one tube engage the ribs 100 on the other and the flat portions 46, 48 of the shoulder 30, 32 respectively, are in abutment. Each rib 100 is convex outwardly when viewed in transverse cross section as disclosed in the aforementioned applications Ser. No. 08/707,564.

Preferably, the tubes are brought into engagement and held in assembled relation by the closure, as presently described.

Further, in accordance with the invention and referring to FIGS. 2–13, a closure 110 is applied to the assembled tubes and comprises a first closure portion 112 which snaps over the assembled finishes 26, 28, respectively, and a second closure portion 114 attached to first portion by integral hinges 116.

Integral interengaging means are provided between the upper surface 118 of each finish 26,28 and the first portion 112 and comprise a rectangular groove 120, 122 on each finish 26,28 which are engaged by a complementary ribs 124, 126 on the under side of the base wall 128 of first closure portion 112. The first closure portion 114 also includes a peripheral wall portion 130 which extends from the base wall 128 and includes peripheral bead 132 on the inner surface thereof engaging peripheral U-shaped beads 134, 136 on the finishes 26, 28, respectively. The base wall 128 comprises spaced diametrical walls 138, 140 which defined ribs 126.

Second closure portion 114 includes a base wall 142 and a rectangular peripheral wall 144. A straight groove 146 is provided on the underside of base wall 142 and sealingly engages a straight rib 148 on the base wall 128 of the first closure portion 112.

Preferably, the hinge between the closure portions 112, 114 is of the type shown in U.S. Pat. Nos. 4,638,916 and 5,489,035, incorporated herein by reference.

The package is inverted and filled and then the lower ends of the tubes are pinched together and sealed as at 150 to form the filled package.

The dual dispensing closure embodying the invention can also be applied to a dual dispensing container comprising dual bottles with abutting flat walls. It is also applicable to a dual chamber container having a single wall in place of the two abutting walls between the two chambers. The single wall would contain the two grooves engaged by the ribs 126.

It can thus be seen that there has been provided a dispensing package which includes a closure that is readily applied and provides access to the two chambers by single motion of opening the closure; wherein the closure provides a seal without the need for resilient seals; wherein the closure can be readily applied by a snap action; a dual flexible tube package which will effectively segregate active ingredients in the respective tubes; which is more readily manufactured; which is more readily filled; and which is more readily sealed.

We claim:

1. The method of making a dual chamber package comprising forming a plastic container means comprising dual chambers for containing products to be dispensed by pressure, forming each chamber having an outlet, forming said outlets being in side-by-side relation, forming said outlet with an annular wall, forming a common wall mean between said outlets defined by portions of said outlet, forming said wall with a raised rounded lateral sealing surface, forming a plastic closure with a first portion and a second portion hinged to the first portion, forming said first portion with first dual annular integral sealing means, forming each said outlet with second complementary integral sealing means engaged by one of said first integral sealing means, forming said first portion of said closure with third dual annular integral sealing means, and forming said second portion of said closure with fourth dual annular integral sealing means engaging said third dual annular integral sealing means.

2. The method set forth in claim 1 wherein said step of forming said first sealing means and third sealing means comprises forming bead means and wherein said step of forming each said second sealing means and fourth sealing means comprises forming groove means.

3. The method set forth in claim 2 wherein said step of forming common wall means comprises forming dual walls.

4. The method set forth in claim 1 wherein said step of forming container means comprises forming a pair of plastic tubes, forming said tube with a rigid finish, a shoulder adjacent the finish and a thin flexible body extending from said shoulder, forming said finish, said shoulder and said body of each said flexible tube having a generally flat wall and an integral interconnecting wall extending from said flat wall, forming said flat walls into abutting relation to said common wall means.

5. The method set forth in claim 4 wherein said step of forming each said shoulder, and said body of each said flexible tube is such that they are generally D-shaped in cross section, and each said finish is generally rectangular.

6. The method set forth in claim 5 wherein said step of forming integral sealing means comprises forming groove means on one of said closure and finish and forming complementary rib means on the other of said closure and finish.

7. The method set forth in claim 6 wherein said step of forming first portion comprises forming rib means thereon and each said finish comprises forming grooves means thereon engaged by said rib means.

8. The method set forth in claim 7 wherein said step of forming interengaging means between said finishes and said closure comprises forming snap bead means on said finishes and said first closure portion.

* * * * *